US009926878B2

(12) United States Patent
Suzuki

(10) Patent No.: US 9,926,878 B2
(45) Date of Patent: Mar. 27, 2018

(54) HIGH PRESSURE PUMP CONTROLLER

(71) Applicant: DENSO CORPORATION, Kariya, Aichi-pref. (JP)

(72) Inventor: Masahiko Suzuki, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/264,635

(22) Filed: Sep. 14, 2016

(65) Prior Publication Data

US 2017/0089291 A1 Mar. 30, 2017

(30) Foreign Application Priority Data

Sep. 24, 2015 (JP) ..... 2015-186809

(51) Int. Cl.

| | |
|---|---|
| ***F02D 41/38*** | (2006.01) |
| ***F04B 19/22*** | (2006.01) |
| ***F02D 41/30*** | (2006.01) |
| ***F02M 59/02*** | (2006.01) |
| ***F02M 59/46*** | (2006.01) |
| ***F04B 49/06*** | (2006.01) |
| ***F04B 49/22*** | (2006.01) |
| ***F04B 7/00*** | (2006.01) |

(Continued)

(52) U.S. Cl.

CPC ..... *F02D 41/38* (2013.01); *F02D 41/3082* (2013.01); *F02D 41/3845* (2013.01); *F02M 59/022* (2013.01); *F02M 59/466* (2013.01); *F04B 7/0076* (2013.01); *F04B 9/042* (2013.01); *F04B 19/22* (2013.01); *F04B 49/065* (2013.01); *F04B 49/22* (2013.01); *F04B 53/001* (2013.01); *F04B 53/1032* (2013.01); *F02D 2041/2003* (2013.01); *F02D 2041/2037* (2013.01); *F02D 2041/389* (2013.01); *F02D 2200/0602* (2013.01); *F02D 2200/501* (2013.01); *F04B 2201/0201* (2013.01)

(58) Field of Classification Search

CPC ..... F02D 59/022; F02D 59/466; F02D 41/38; F02D 41/3836; F02D 41/3845; F04B 7/0076; F04B 9/042; F04B 19/22

USPC ..... 123/495, 508

See application file for complete search history.

(56) References Cited

U.S. PATENT DOCUMENTS

2011/0265765 A1* 11/2011 Furuhashi ..... F02D 41/08 123/446

2013/0032212 A1 2/2013 Tokuo et al.

(Continued)

FOREIGN PATENT DOCUMENTS

JP 2015-21428 A 2/2015

*Primary Examiner* — Mahmoud Gimie

(74) *Attorney, Agent, or Firm* — Posz Law Group, PLC

(57) ABSTRACT

When a plunger of a high pressure pump is rising, a high pressure pump controller closes a regulator valve by energizing a solenoid of an electromagnetic actuator of the high pressure pump to discharge fuel into a delivery pipe. Further, this fuel discharge energization is stopped before the plunger reaches top dead center at a pump TDC timing. Further, a fuel pressure of the delivery pipe is detected at the pump TDC timing, and based on that detected value, a time Td from the pump TDC timing until a valve opening timing of the regulator valve is estimated. Once the estimated time Td elapses from the pump TDC timing, the solenoid is reenergized to removed a movement speed of a movable portion in a direction that pushes the regulator valve in an opening direction.

6 Claims, 11 Drawing Sheets

(51) Int. Cl.

| | |
|---|---|
| ***F04B 9/04*** | (2006.01) |
| ***F04B 53/00*** | (2006.01) |
| ***F04B 53/10*** | (2006.01) |
| *F02D 41/20* | (2006.01) |

(56) References Cited

U.S. PATENT DOCUMENTS

2016/0186707 A1* 6/2016 Sakamoto ..... F02M 63/0049
417/505
2016/0186741 A1* 6/2016 Sakamoto ..... F02M 63/0049
417/290

* cited by examiner

HIGH PRESSURE PUMP CONTROLLER

CROSS REFERENCE TO RELATED APPLICATION

The present application is based on Japanese Patent Application No. 2015-186809 filed on Sep. 24, 2015, disclosure of which is incorporated herein by reference.

TECHNICAL FIELD

The present disclosure relates to a high pressure pump controller.

BACKGROUND

In a system that supplies fuel to a direct injection type engine, a low pressure fuel is drawn by an electric pump from a fuel tank, and supplied to a high pressure pump driven by the engine. A high pressure fuel discharged from this high pressure pump is then pumped to a fuel storage unit. Then, high pressure fuel is supplied from this fuel storage unit to each of a plurality of injectors.

For example, as described in JP 2013-32750 A, a high pressure pump includes a pressurizing chamber and a plunger. The pressurizing chamber includes an inlet and an outlet for fuel, and the plunger reciprocates within the pressurizing chamber. The pressurizing chamber is also referred to as a pump chamber. In addition, the high pressure pump includes a valve, a valve bias spring, and an electromagnetic actuator. The valve acts as a flow regulator by opening and closing a fuel passage connected to the inlet. The valve bias spring biases the valve in a direction that causes the valve to close the fuel passage (hereinafter, referred to as a closing direction).

In addition, the electromagnetic actuator causes the valve to move, i.e., to open and close. The electromagnetic actuator includes a movable rod and a solenoid. The rod is biased by a spring to push the valve in an opening direction opposite to the closing direction. The solenoid, when energized, attracts the rod in a direction opposite to the pushing direction of the rod on the valve.

According to this type of high pressure pump, during a rise period where the plunger is rising from bottom dead center to top dead center, the solenoid is energized to close the valve. Accordingly, the fuel in the pressurizing chamber is discharged from the outlet to the fuel storage unit. In addition, during the rise period of the plunger, even if the solenoid is deenergized after the valve closes, the valve is maintained in an open state by the fuel pressure in the pressurizing chamber.

However, according to this type of high pressure pump, if the closed valve moves in the opening direction and forcefully collides with a stopper placed at an end position in the opening direction, an unpleasant sound may occur.

For this reason, according to the controller described in JP 2013-32750 A, during the rise period of the plunger, after the valve closes due to energizing the solenoid, the solenoid is then deenergized. After that, when the plunger begins to fall from top dead center, the solenoid is reenergized. Here, an opening actuation direction of the movable rod refers to the direction in which the rod pushes the valve to cause the valve to open. By reenergizing the solenoid, the movement speed of the rod in the open actuation direction is reduced. Accordingly, the speed at which the valve collides with the stopper is reduced, and the resulting noise is reduced.

SUMMARY

According to the controller described in JP 2013-32750 A, it is not clear how the start timing for reenergizing the solenoid is decided.

For example, if the start timing for reenergizing the solenoid is after a valve opening timing (referring to when the valve begins to open the fuel passage), then the timing for slowing the movement speed of the rod is delayed. As such, the movement speed reduction effect on the valve in the opening direction is reduced. Accordingly, the noise reduction effect is also reduced. Conversely, if the start timing for reenergizing the solenoid is earlier than the valve opening timing, the energization performed prior to the valve opening start timing does not significantly contribute to noise reduction. As such, electric power may be excessively consumed.

In this regard, it is an object of the present disclosure to provide a high pressure pump controller that reduces noise generated in a high pressure pump, and at the same time reduces power consumption for the noise reduction.

According to the present disclosure, a high pressure pump controller for controlling a high pressure pump includes a discharge energizer, an estimator, and a reenergizer, wherein the high pressure pump includes a pump chamber having an inlet and an outlet for fuel, a plunger that reciprocates within the pump chamber, a regulator valve that opens and closes a fuel passage connected to the inlet, a first spring that biases the regulator valve in a closing direction along a movement direction of the regulator valve, the regulator valve configured to close the fuel passage in the closing direction, and an electromagnetic actuator that causes the regulator valve to move to open and close. The electromagnetic actuator includes a movable portion biased by a second spring in an opening actuation direction to push the regulator valve in an opening direction, the opening direction being opposite to the closing direction, and a solenoid that, when energized, attracts the movable portion in a direction opposite to the opening actuation direction. The outlet is connected to a fuel storage unit which stores fuel to be supplied to an injector.

Further, a plunger rise period is defined as when the plunger is rising from bottom dead center to top dead center, and during the plunger rise period, the solenoid is energized to close the regulator valve such that fuel in the pump chamber is discharged from the outlet into the fuel storage unit, and during the plunger rise period, once the regulator valve is closed, even if the solenoid is deenergized, the regulator valve is maintained in a closed state by a fuel pressure of the pump chamber.

The discharge energizer is configured to, during the plunger rise period, energize the solenoid to close the regulator valve and to discharge the fuel from the outlet, and the discharge energizer is configure to, prior to the plunger reaching top dead center, deenergize the solenoid.

The estimator is configured to estimate a valve opening timing based on a fuel pressure of the fuel storage unit, the valve opening timing being when the regulator valve begins to open the fuel passage as a result of the discharge energizer deenergizing the solenoid.

Further, the reenergizer is configured to, upon reaching the valve opening timing estimated by the estimator, reenergize the solenoid to reduce a movement speed of the movable portion in the opening actuation direction.

The valve opening timing of the regulator valve changes according to the fuel pressure of the pump chamber when the plunger is close to top dead center, and the fuel pressure of the pump chamber is correlated with the fuel pressure of the fuel storage unit. Accordingly, the high pressure pump controller of the present disclosure estimates the valve opening timing of the regulator valve based on the fuel pressure of the fuel storage unit, and begins reenergizing the solenoid upon reaching that estimated valve opening timing. This reenergization reduces the movement speed of the movable portion in the opening actuation direction, and reduces a speed at which the regulator valve collides with a component at a terminal position in the opening direction. Accordingly, this reenergization is for reducing a noise generated by the collision between that component and the regulator valve.

According to such a high pressure pump controller, the timing for starting the reenergization of the solenoid to reduce noise may be matched with, or set close to, the actual valve opening timing of the regulator valve. For this reason, it is possible to avoid starting the reenergization too late, which may reduce the noise reduction effect of the reenergization process. Further, it is possible to avoid starting the reenergization too early, which may consume excess power. Accordingly, it is possible to both reduce noises generated in the high pressure pump, and at the same time avoid consuming excess energy during the noise reduction process.

BRIEF DESCRIPTION OF THE DRAWINGS

The disclosure, together with additional objectives, features and advantages thereof, will be best understood from the following description, the appended claims and the accompanying drawings, in which:

DETAILED DESCRIPTION

Next, an exemplary embodiment of the present disclosure will be explained with reference to the figures.

(Overall Configuration)

Figure 1:
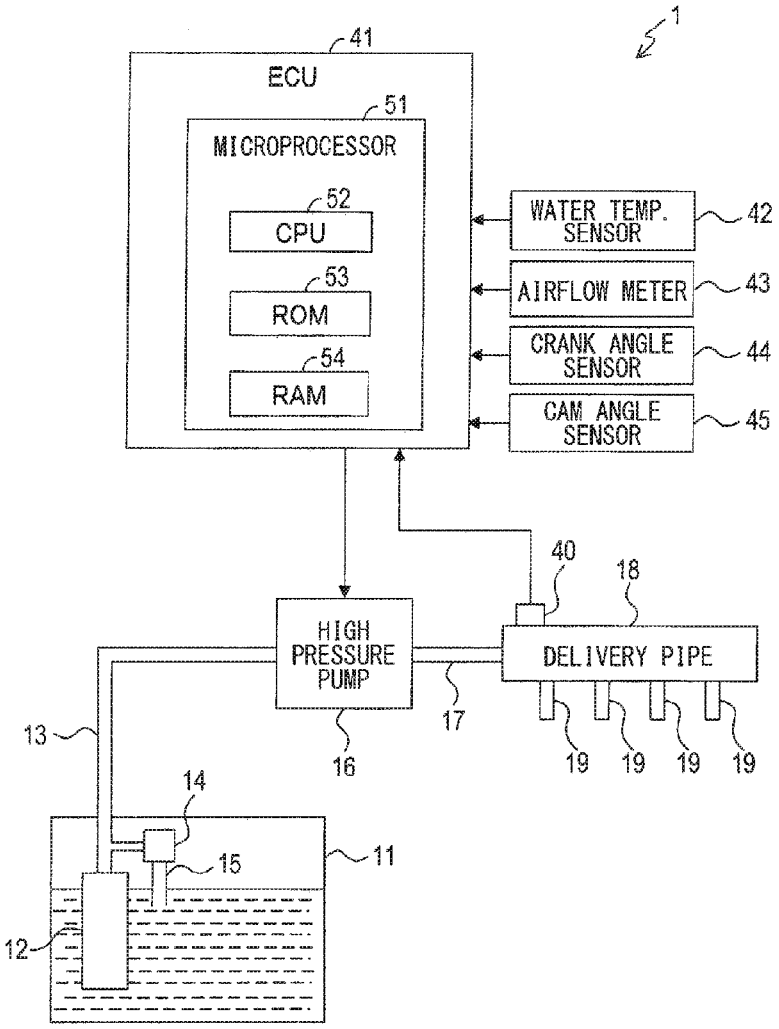
FIG. 1 is a block diagram showing the overall configuration of a fuel supply system of an embodiment.

A fuel supply system 1 of the embodiment shown in FIG. 1 supplies fuel to an engine of a vehicle.

The fuel supply system 1 includes a fuel tank 11 that stores fuel, a low pressure pump 12, a low pressure fuel pipe 13, a pressure regulator 14, a fuel return pipe 15, a high pressure pump 16, a high pressure fuel pipe 17, a delivery pipe 18, and a plurality of injectors 19. One injector 19 is provided for each cylinder of the engine. In this example, four injectors 19 are provided.

The low pressure pump 12 is driving by an electric motor powered by a battery of the vehicle. The low pressure pump 12 draws up the fuel in the fuel tank 11. The fuel discharged from the low pressure pump 12 is supplied through the low pressure fuel pipe 13 and into the high pressure pump 16.

The pressure regulator 14 is connected to the low pressure fuel pipe 13. The pressure of the fuel supplied form the low pressure pump 12 to the high pressure pump 16 is regulated to a predetermined constant pressure by the pressure regulator 14. Of the fuel discharged from the low pressure pump 12, any fuel which exceeds this constant pressure is returned through the fuel return pipe 15 and into the fuel tank 11.

The high pressure pump 16 compresses the low pressure fuel supplied through the low pressure fuel pipe 13, and discharges the compressed fuel. The high pressure fuel discharged from the high pressure pump 16 flows through the high pressure fuel pipe 17 and is stored in the delivery pipe 18. Then, this high pressure fuel is distributed from the delivery pipe 18 to each of the injectors 19. The high pressure fuel is then injected from each of the injectors 19 into each cylinder.

Figure 2:
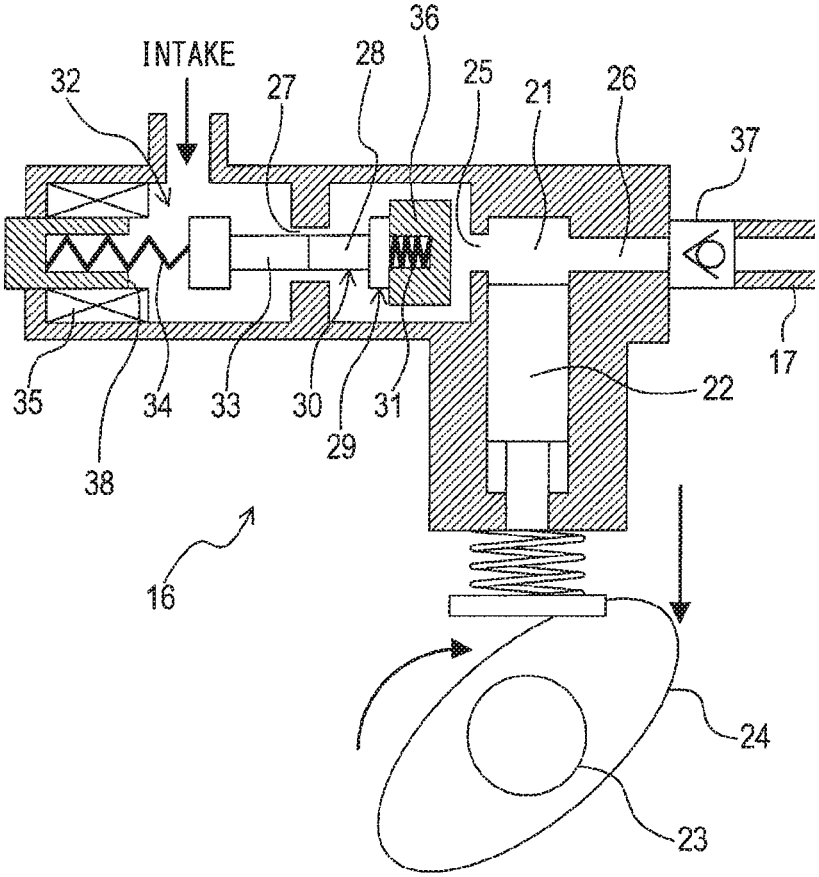
FIG. 2 is an outline configuration view showing a high pressure pump when intaking fuel.
Figure 3:
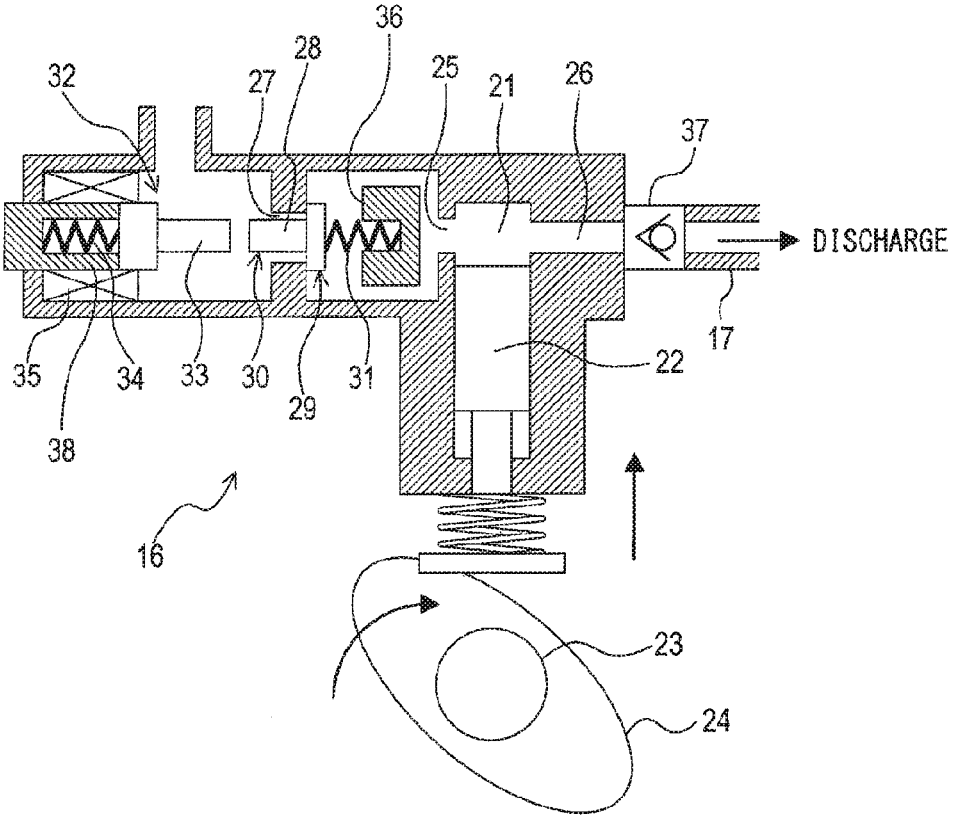
FIG. 3 is an outline configuration view showing a high pressure pump when discharging fuel.

As shown in FIGS. 2 and 3, the high pressure pump 16 includes a cylindrical pump chamber 21 and a plunger 22. The high pressure pump 16 is a plunger-type pump that intakes and discharges fuel as the plunger 22 reciprocates within the pump chamber 21.

The plunger 22 is driven by the rotation of a cam 24 attached to a camshaft 23 of the engine. In this example, the camshaft 23 is a camshaft that causes the exhaust valve of the engine to open and close. However, the camshaft 23 may be a camshaft that causes the intake valve of the engine to open and close instead.

The pump chamber 21 includes an inlet 25 and an outlet 26. The inlet 25 is for intaking low pressure fuel into the pump chamber 21. The outlet 26 is for discharging the high pressure fuel in the pump chamber 21 to outside of the high pressure pump 16. The inlet 25 is connected to a fuel passage 27 within the high pressure pump 16. The low pressure fuel, which is supplied to the high pressure pump 16 from the low pressure pump 12 through the low pressure fuel pipe 13, flows through the fuel passage 27 to arrive at the inlet 25. Then, the low pressure fuel is sucked through the inlet 25 and into the pump chamber 21.

The high pressure pump 16 includes a regulator valve 28 that opens and closes the fuel passage 27, a spring 31 that biases the regulator valve 28 toward a closed position, and an electromagnetic actuator 32 that causes the regulator valve 28 to move in opening and closing directions.

The closed position of the regulator valve 28 is defined as a position in which the regulator valve 28 is in a closed state to close the fuel passage 27. The regulator valve 28 is illustrated in the closed position in FIG. 3. The regulator valve 28 may simply be referred to as being closed when in this closed state. In addition, a closing direction refers to a movement direction of the regulator valve 28 toward the closed position. An opening direction thus refers to the opposite direction as the closing direction. In FIGS. 2 and 3, the closing direction is toward the left, while the opening direction is toward the right.

The regulator valve 28 includes a valve body 29 and a pressing portion 30. The valve body 29 opens and closes the fuel passage 27. The pressing portion 30 is disposed to protrude from the valve body 29 toward the electromagnetic actuator 32. Here, the pressing portion 30 is pushed by a movable portion 33 of the electromagnetic actuator 32 in the opening direction.

A stopper portion 36 is disposed in the high pressure pump 16. When the regulator valve 28 moves in the opening direction, as shown in FIG. 2, the regulator valve 28 moves until reaching a terminal position, at which point the valve body 29 is abutting the stopper portion 36. This position is referred to as a fully open position of the regulator valve 28.

The electromagnetic actuator 32 includes the movable portion 33, a spring 34, and a solenoid 35. The spring 34 biases the movable portion 33 in a direction toward the regulator valve 28. The solenoid 35, while energized, attracts the movable portion 33 in a direction away from the regulator valve 28. The force of the spring 34 is greater than the force of the spring 31. In addition, an opening actuation direction refers to a movement direction of the movable portion 33 toward the regulator valve 28, i.e., a direction in which the movable portion 33 pushes the regulator valve 28 due to the biasing force of the spring 34. Further, a closing actuation direction refers to a direction opposite to the opening actuation direction. In FIGS. 2 and 3, the closing actuation direction is toward the left, and the opening actuation direction is toward the right.

As shown in FIG. 2, when the solenoid 35 is not energized, the movable portion 33 moves in the opening actuation direction due to the force of the spring 34. Accordingly, due to movable portion 33 abutting the pressing portion 30, the regulator valve 28 is pushed in the opening direction. Then, if the fuel pressure in the pump chamber 21 (hereinafter, referred to as a pump chamber pressure) is low, the regulator valve 28 moves from the closed position toward the opening direction, and the fuel passage 27 is opened. The regulator valve 28 may be simply referred to as being open when in an open state that opens the fuel passage 27.

For this reason, as shown in FIG. 2, during a period in which the plunger 22 is falling from top dead center and the volume of the pump chamber 21 is increasing (hereinafter, referred to as a plunger fall period), if the solenoid 35 is deenergized, the regulator valve 28 opens. Then, when the regulator valve 28 opens, low pressure fuel is sucked into the pump chamber 21 through the fuel passage 27 and the inlet 25. This period of fuel intake into the pump chamber 21 corresponds to an intake stroke.

In addition, as shown in FIG. 3, when the solenoid 35 is energized, the movable portion 33 moves in the closing actuation direction due to the electromagnetic attraction force from the solenoid 35. Accordingly, the movable portion 33 separates from the pressing portion 30. As a result, the regulator valve 28 moves in the closing direction due to the force of the spring 31, and is retained in the closed position by the force of the spring 31. In other words, the regulator valve 28 is closed.

For this reason, during a period in which the plunger 22 is rising from bottom dead center and the volume of the pump chamber 21 is decreasing (hereinafter, referred to as a plunger rise period), if the regulator valve 28 closes due to the solenoid 35 being energized, the fuel in the pump chamber 21 is compressed and discharged from the outlet 26.

The outlet 26 is connected to the delivery pipe 18 through the high pressure fuel pipe 17. In addition, a check valve 37 is disposed in the high pressure pump 16 near the outlet 26. The check valve 37 prevents the discharged fuel from flowing in reverse. The fuel discharged from the outlet 26 is the high pressure fuel discharged from the high pressure pump 16. The period during which fuel is being discharged from the outlet 26 is referred to as a discharge stroke.

It should be noted that the regulator valve 28 closes part way through the plunger rise period. Until the regulator valve 28 closes, the fuel in the pump chamber 21 is discharged through the inlet 25 and the fuel passage 27 into the low pressure fuel pipe 13. This period of time is referred to as a metering stroke.

A stopper portion 38 houses the spring 34. The movement range of the movable portion 33 includes a terminal position in the closing actuation direction. As shown in FIG. 3, when reaching this terminal position, the movable portion 33 is abutting the stopper portion 38. This position is referred to as a closed terminal position of the movable portion 33.

In addition, the movement range of the movable portion 33 also includes a terminal position in the opening actuation direction. As shown in FIG. 2, upon reaching this position, the movable portion 33 is abutting the pressing portion 30 of the regulator valve 28 while the regulator valve 28 is in its fully open position. This position is referred to as an open terminal position of the movable portion 33.

According to the high pressure pump 16, the energizing start timing of the solenoid 35 is controlled during the plunger rise period. Due to this, the closed period of the regulator valve 28 is controlled during the plunger rise period. In other words, the fuel discharge amount is controlled. By controlling the amount of fuel discharged from the high pressure pump 16, the fuel pressure in the delivery pipe 18 (hereafter, referred to as a pipe pressure) is controller.

For example, the pipe pressure may be increased by energizing the solenoid 35 earlier during the plunger rise period. In this case, the regulator valve 28 is closed for a longer period of time during the plunger rise period, and the amount of discharged fuel is increased. Conversely, the pipe pressure may be decreased by energizing the solenoid 35 later during the plunger rise period. In this case, the regulator valve 28 is closed for a shorter period of time during the plunger rise period, and the amount of fuel discharged is reduced.

Further, as shown in FIG. 1, a pressure sensor 40 is disposed in the delivery pipe 18 to detect the pipe pressure. The fuel supply system 1 includes an electronic control unit (ECU) 41 that at least controls the high pressure pump 16 and the injectors 19.

The pressure sensor 40 outputs a signal to the ECU 41. In addition, signals for detecting various operating conditions of the engine at output to the ECU 41. For example, signals from various sensors such as a water temperature sensor 42, an airflow meter 43, a crank angle sensor 44, and a cam angle sensor 45 are output to the ECU 41.

The pressure sensor 40 outputs a voltage signal corresponding to the pipe pressure. The water temperature sensor 42 outputs a voltage signal corresponding to the coolant temperature of the engine. The airflow meter 43 outputs a voltage signal corresponding to the air intake rate of the engine.

The crank angle sensor 44 outputs a signal that includes a pulse per fixed crank angle in accordance with the rotation of the crankshaft of the engine. In particular, the signal of the crank angle sensor 44 includes a characteristic waveform that shows when the crank angle position reaches a predetermined position. For example, the characteristic waveform may show a longer interval between pulses than normal. In addition, the crank angle is the rotation angle of the crankshaft, and the crank angle position is the rotation position of the crankshaft.

In addition, the output signal of the cam angle sensor 45 represents, for example, the rotation position of the camshaft 23 arriving at a predetermined reference position.

The ECU 41 detects a crank angle position (hereinafter referred to as an engine position) and an engine rotation speed based on the output signal of the crank angle sensor 44 and the output signal of the cam angle sensor 45, over a period of two rotations of the crankshaft.

The ECU 41 includes a microcomputer (also referred to as a microprocessor) 51 that acts as a controller governing the operation of the ECU 41. Further, while not illustrated, the ECU 41 also includes a pump drive circuit and an injector drive circuit. The pump drive circuit energizes the high pressure pump 16 and the solenoid 35 based on drive signals from the microprocessor 51. The injector drive circuit drives each of the injectors 19 based on injection command signals from the microprocessor 51.

The microprocessor 51 includes a CPU 52, a ROM 53, and a RAM 54. The microprocessor 51 detects the pipe pressure based on the signal from the pressure sensor 40, and detects the operating condition of the engine based on the signals from the other various sensors. Then, the microprocessor 51 controls the high pressure pump 16 and each of the injectors 19 based on the detected pipe pressure and engine operating conditions.

The various processes performed by the microprocessor 51 correspond to programs, stored on non-transitory computer readable storage media, executed by the CPU 52. For example, the ROM 53 may correspond to a non-transitory computer readable storage medium having programs stored thereon. In addition, by executing these programs, the CPU 52 performs methods corresponding to these programs. In addition, the number of microprocessors constituting the controller may be 1 or more. Further, the implementation of the controller is not limited to software, and a portion or all of the controller may be implemented using a combination of logic circuits and analog circuits.

(High Pressure Pump Controls)

The microprocessor 51 calculates a target pipe pressure, which is a target value for the pipe pressure, based on the operating conditions of the engine. Further, the microprocessor 51 calculates an energization start timing for the solenoid 35 in order to reach that target pipe pressure. This energization start timing is calculated as a point in time during the plunger rise period.

Figure 4:
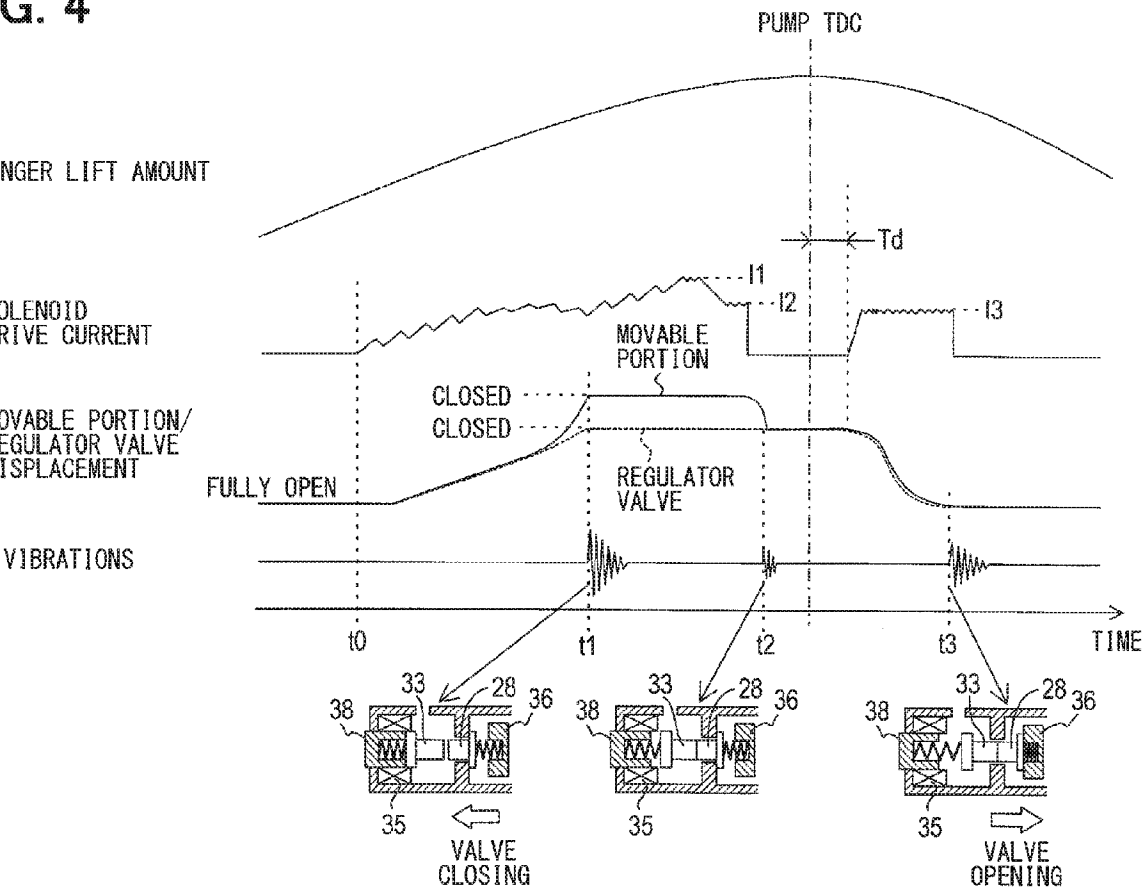
FIG. 4 is an explanatory view for an outline of controlling a high pressure pump and a reenergization process.

Then, as shown at time t0 in FIG. 4, upon reaching the calculated energizing start timing, the microprocessor 51 starts energizing the solenoid 35. In the following explanation related to FIG. 4 and subsequent figures, a "plunger lift amount" is defined as the amount the plunger 22 has lifted from bottom dead center, a "solenoid drive current" is defined as the current flowing in the solenoid 35, and a "pump TDC timing" is defined as a point in time at which the plunger 22 is at top dead center.

Before energization of the solenoid 35 begins, the high pressure pump 16 is in the state shown in FIG. 2. In other words, the regulator valve 28 is in the fully open position, and the movable portion 33 is in the open terminal position.

Then, as shown in FIG. 4, upon the solenoid 35 being energized, the movable portion 33 moves from the open terminal position to the closed terminal position, and accordingly the regulator valve 28 moves from the fully open position to the closed position. In other words, as shown in FIG. 3, the high pressure pump 16 reaches a state where the regulator valve 28 is closed. As a result, fuel begins to be discharged from the high pressure pump 16.

Further, as shown at time t1 in FIG. 4, when the movable portion 33 reaches the closed terminal position, vibrations are generated due to the movable portion 33 colliding with the stopper portion 38. In order to minimize noise generated from these vibrations, the microprocessor 51 performs a gradual current increase process, in which the solenoid drive current is gradually increased until reaching a target maximum current value I1.

However, depending on the driving state of the vehicle, at times it is easy for a driver to hear the noise generated from the high pressure pump 16, while at other times it is difficult to hear this noise. For this reason, the microprocessor 51 stores a noise reduction implementation condition. When this condition is met, the vehicle is in a driving state in which it is easy for the driver to hear noises from the high pressure pump 16. When the microprocessor 51 determines that this noise reduction implementation condition is met, the microprocessor 51 performs the above described gradual current increase process as a noise reduction procedure. The noise reduction implementation condition may be, for example, that the vehicle is stopped, or the vehicle is traveling at or below a predetermined speed. In addition, when the microprocessor 51 determines that the noise reduction implementation condition is not met, the microprocessor 51 does not perform the above described gradual current increase process. Instead, the microprocessor 51 controls the solenoid drive current to quickly increase until reaching the target maximum current I1.

Next, after the solenoid drive current reaches the target maximum current I1, the microprocessor 51 maintains the solenoid drive current at a retention current I2 which is lower than the target maximum current I1. The retention current I2 is the smallest current sufficient to retain the movable portion 33 at the closed terminal position.

Next, as shown in FIG. 4, the microprocessor 51 deenergizes the solenoid 35 prior to reaching the pump TDC timing.

When the solenoid 35 is deenergized, the movable portion 33 moves from the closed terminal position in the opening actuation direction, and collides with the pressing portion 30 of the regulator valve 28. As a result, the regulator valve 28 is pushed in the opening direction. However, during the plunger rise period, is closed regulator valve 28 is also being pushed in the closing direction by the high pressure fuel in the pump chamber 21. In addition, the force of that fuel pushing the regulator valve 28 in the closing direction is greater than the pushing force by the movable portion 33 (i.e., the force of the spring 34) in the opening direction.

For this reason, after the regulator valve 28 closes, even if the solenoid 35 is deenergized during the plunger rise period, the regulator valve 28 is maintained in a closed state.

Further, as shown at time t2 of FIG. 4, when the solenoid 35 is deenergized and the movable portion 33 collides into the pressing portion 30 of the closed regulator valve 28, vibrations are generated. The noise generated from these vibrations are small enough to be ignored.

Next, once the plunger 22 reaches top dead center, fuel discharge from the high pressure pump 16 ends.

Then, the plunger 22 begins descending from top dead center, and the pump chamber pressure decreases. As a result, the regulator valve 28 moves from the closed position in the opening direction. In other words, the regulator valve 28 opens.

Here, suppose the solenoid 35 were maintained in a deenergized state. In this case, the regulator valve 28 is pushed in the opening direction by the force from the movable portion 33 as well as the negative pressure in the pump chamber 21 as the plunger 22 falls. As a result, the regulator valve 28 forcefully moves in the opening direction and collides into the stopper portion 36, generating vibrations. The noise from these vibrations is relatively large, and may be heard by the driver if, for example, the vehicle were stopped or travelling at low speeds.

In this regard, if the previously mentioned noise reduction implementation condition was determined to be unmet, the microprocessor 51 does not energize the solenoid 35 until the subsequent plunger rise period. However, if the noise reduction implementation condition was determined to be met, the microprocessor 51 performs the following reenergization processing in order to reduce noise.

(Reenergization Process)

As shown in FIG. 4, at the pump TDC timing, the microprocessor 51 estimates a valve opening timing for the regulator valve 28. The valve opening timing is a point in time at which the regulator valve 28 begins to open the fuel passage 27. More specifically, the valve opening timing is a point in time at which the regulator valve 28 begins to move from the closed position in the opening direction.

Then, the microprocessor 51 reenergizes the solenoid 35 at the estimated valve opening timing, thereby reducing the movement speed of the movable portion 33 in the opening actuation direction. When the movement speed of the movable portion in the opening actuation direction is reduced, the movement speed of the regulator valve 28 in the opening direction is reduced. Accordingly, it is possible to reduce the amount of vibrations and noise generated when the regulator valve 28 collides with the stopper portion 36.

Specifically, in order to estimate the valve opening timing of the regulator valve 28, the microprocessor 51 estimates a time delay Td (hereinafter referred to as a valve opening time delay) between the pump TDC timing and the valve opening timing of the regulator valve 28. Once the estimated valve opening time delay Td elapses from the pump TDC timing, the microprocessor 51 reenergizes the solenoid 35. The microprocessor 51 continues reenergizing the solenoid 35 for a predetermined period of time allowing the regulator valve 28 to reach the fully open position.

At time t3 in FIG. 4, the regulator valve 28 reaches the fully open position, i.e., the regulator valve 28 collides with the stopper portion 36. Due to reenergizing the solenoid 35, the vibrations and noise generated at time t3 are smaller than if the solenoid 35 were not reenergized.

This reenergization of the solenoid 35 for reducing noise is intended to apply a braking force on the movable portion 33. For this reason, a reenergization current I3 is set to reduce the movement speed of the movable portion 33 in the opening actuation direction. In other words, the reenergization current I3 is smaller than a current sufficient to cause the movable portion 33 to move in the closing actuation direction. For example, the reenergization current I3 may be set to a value lower than the previously mentioned retention current I2.

Further, in the following explanation, the reenergization of the solenoid 35 for noise reduction is referred to as a noise reduction reenergization, or simply reenergization. In contrast, the energization of the solenoid 35 during the plunger rise period for discharging fuel is referred to as a discharge energization.

(Valve Opening Time Delay Estimation Process)

Figure 5:
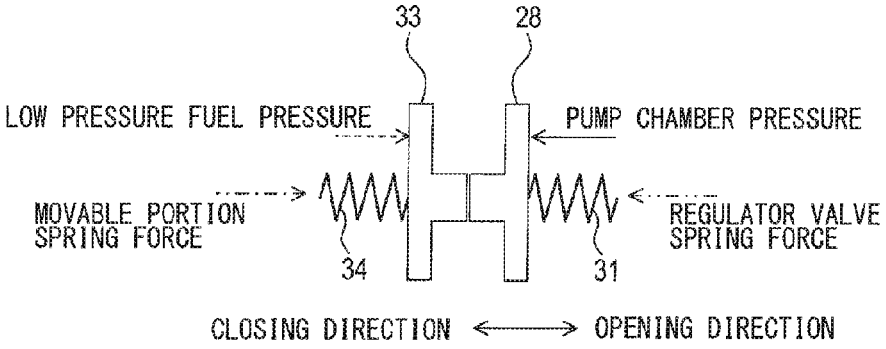
FIG. 5 is an explanatory view for forces applied to a regulator valve.

When the solenoid 35 is not energized, various forces are applied on the regulator valve 28 as shown in FIG. 5. In particular, the force of the spring 31 (hereinafter, a regulator valve spring force) and the pump chamber pressure are applied on the regulator valve 28 in the closing direction. In addition, the force of the spring 34 (hereinafter, a movable portion spring force) and the low pressure fuel pressure is applied on the regulator valve 28 in the opening direction. The low pressure fuel pressure is the pressure of the fuel supplied through the low pressure fuel pipe 13 to the high pressure pump 16.

Accordingly, if the sum of the regulator valve spring force and the pump chamber pressure is smaller than the sum of the movable portion spring force and the low pressure fuel pressure, the closed regulator valve 28 will begin to open, i.e., begin to transition to an open state.

In addition, when near the pump TDC timing, the pump chamber pressure changes based on the pipe pressure. Accordingly, the pump chamber pressure may be estimated based on the pipe pressure, which is detected based on the output signal from the pressure sensor 40.

Figure 6:
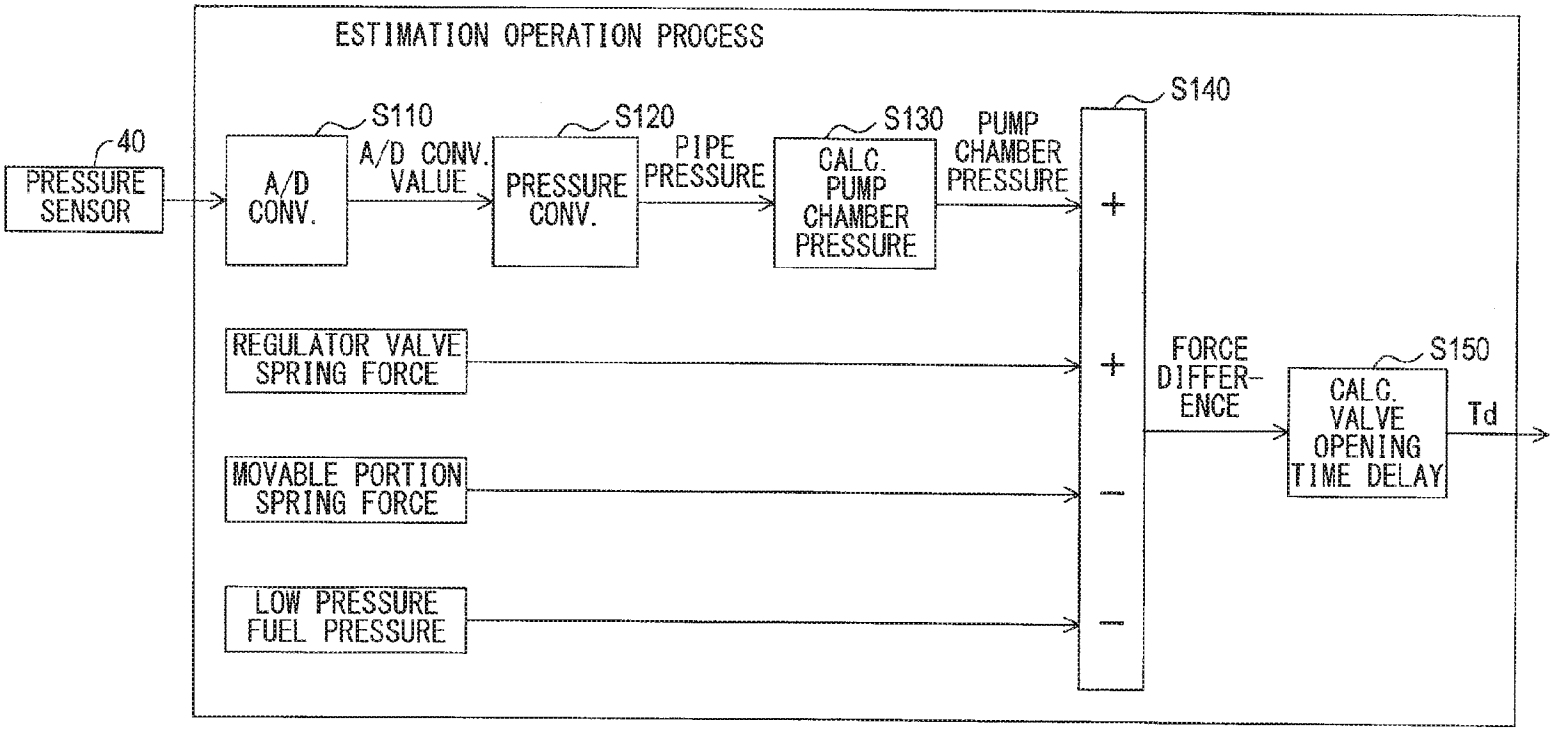
FIG. 6 is a block diagram showing an estimation operation process.

Accordingly, at the pump TDC timing, the microprocessor 51 performs an estimation operation process shown in FIG. 6 as the previously mentioned valve opening time delay Td estimation process.

As shown in FIG. 6, the microprocessor 51 begins the estimation operation process at S110, wherein the output signal of the pressure sensor 40 undergoes A/D conversion. Then, at S120, that A/D converted value is converted into the pipe pressure.

Next, at S130, the microprocessor 51 calculates the pump chamber pressure from the pipe pressure calculated at S120.

If the regulator valve 28 is closed, fuel is discharge from the pump chamber 21 into the high pressure fuel pipe 17 such that the pump chamber pressure is equal to the fuel pressure in the high pressure fuel pipe 17. Since the high pressure fuel pipe 17 also serves to store the high pressure fuel discharged from the high pressure pump 16, the high pressure fuel pipe 17 may be considered to be a portion of the delivery pipe 18. Accordingly, the fuel pressure in the high pressure fuel pipe 17 is equal to the pipe pressure. For this reason, the pump chamber pressure at the pump TDC timing is correlated with the pipe pressure at that same time.

Accordingly, at S130, the microprocessor 51 calculates the pump chamber pressure by substituting the pipe pressure calculated at S120 into a predetermined formula.

This formula outputs a larger value for the pump chamber pressure as the pipe pressure is larger. For example, a formula such as "pump chamber pressure=coefficient A*pipe pressure+offset B" may be used. The formula for calculating the pump chamber pressure may be set through experimentation or derived from theory.

In addition, as another example, the ROM 53 may store a look up table for calculating the pump chamber pressure from the pipe pressure. Then at S130, the microprocessor 51 calculates the pump chamber pressure from this look up table and the pipe pressure calculated at S120. Such a look up table may be defined through experimentation or derived from theory. As another example, at S130, the microprocessor 51 may simply use the pipe pressure calculated at S120 as the pump chamber pressure.

Next, at S140, the microprocessor 51 calculates a force difference by adding the pump chamber pressure calculated as S130 to the regulator valve spring force, then subtracting from this sum the movable portion spring force and the low pressure fuel pressure. This force difference corresponds to value obtained by subtracting the forces applied to the regulator valve 28 in the opening direction from the forces applied to the regulator valve 28 in the closing direction.

Accordingly, when this force difference transitions from positive to negative, the regulator valve 28 begins to open from a closed state.

Further, the low pressure fuel pressure used to calculate the force difference is regulated to a constant value. Accordingly, either a constant value from design or a detected value may be used as the low pressure fuel pressure. For example, in the case of a detected value, a pressure sensor may be disposed in the low pressure fuel pipe 13. Then, the low pressure fuel pressure may be detected by A/D converting the detection signal from that pressure sensor. In addition, both the regulator valve spring force and the movable portion spring force used in calculating the force difference may be constant values from design.

Next, at S150, the microprocessor 51 calculates the valve opening time delay Td from the force difference calculated at S140. The ROM 53 stores a valve opening time delay calculation table that expresses a relationship between the force difference and the valve opening time delay Td. Then, the microprocessor 51 uses that valve opening time delay calculation table to calculate the valve opening time delay Td corresponding to the force difference calculated at S140. Here, calculating the valve opening time delay Td corresponds to estimating the valve opening time delay Td.

Figure 7:
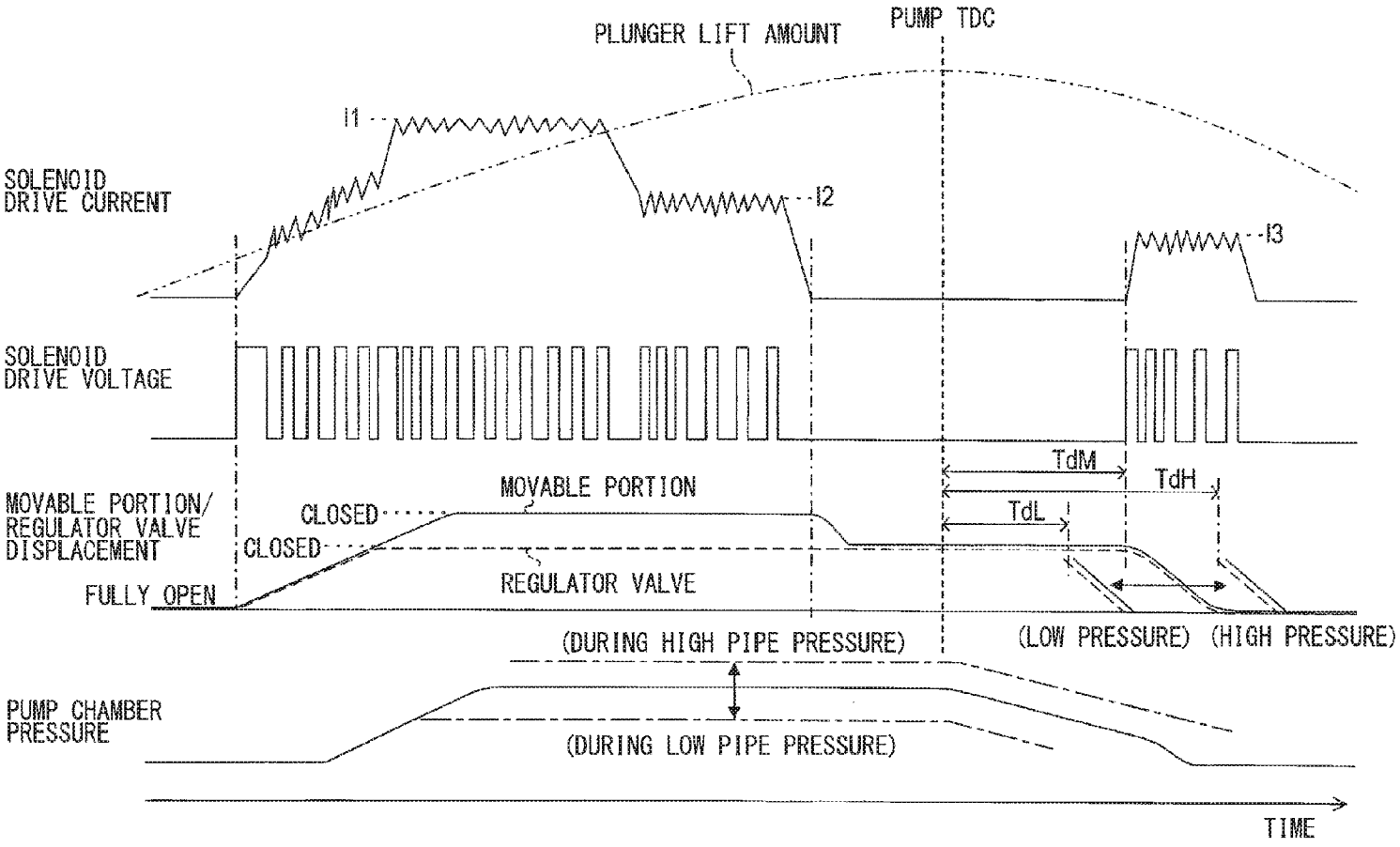
FIG. 7 is an explanatory view of a relationship between pump chamber pressure and valve opening time delay.

As shown in FIG. 7, the greater (or higher) the pump chamber pressure is at the pump TDC timing, the greater the above described force difference is at the pump TDC timing. Then, the greater the force difference is at the pump TDC timing, the longer it takes for the force difference to transition from positive to negative due to the pump chamber pressure decreasing as the plunger 22 falls. In other words, the valve opening time delay Td is longer.

In FIG. 7, "TdM" refers to a valve opening time delay Td when the pump chamber pressure at the pump TDC timing is equal to a predetermined value. Further, "TdL" refers to a valve opening time delay Td when the pump chamber pressure at the pump TDC timing is smaller (or lower) than the predetermined value. In addition, "TdH" refers to a valve opening time delay Td when the pump chamber pressure at the pump TDC timing is greater than the predetermined value. In FIG. 7, "solenoid drive voltage" refers to the voltage applied to the solenoid 35. This voltage is for controlling the solenoid drive current, and is applied using PWM (pulse width modulation).

Figure 8:
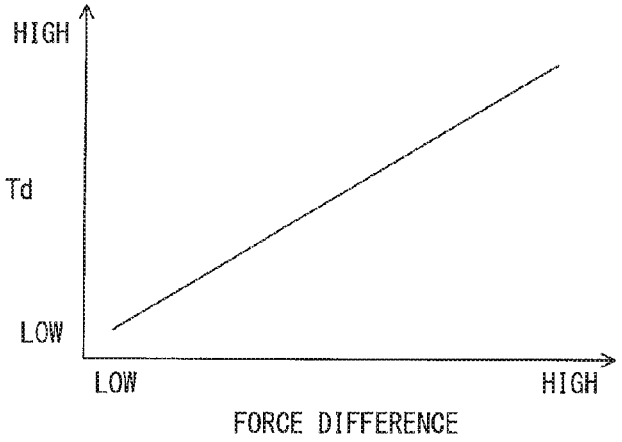
FIG. 8 is an explanatory view of a table for calculating a valve opening time delay.

Accordingly, as shown in FIG. 8 the valve opening time delay calculation table used to calculate the valve opening time delay Td is set such that as the force difference calculated as S140 of FIG. 6 increases, the calculated valve opening time delay Td is longer.

(Details of Processing by Microprocessor)

First, a reference position process and an energize timing setting process will be described.

Figure 9:
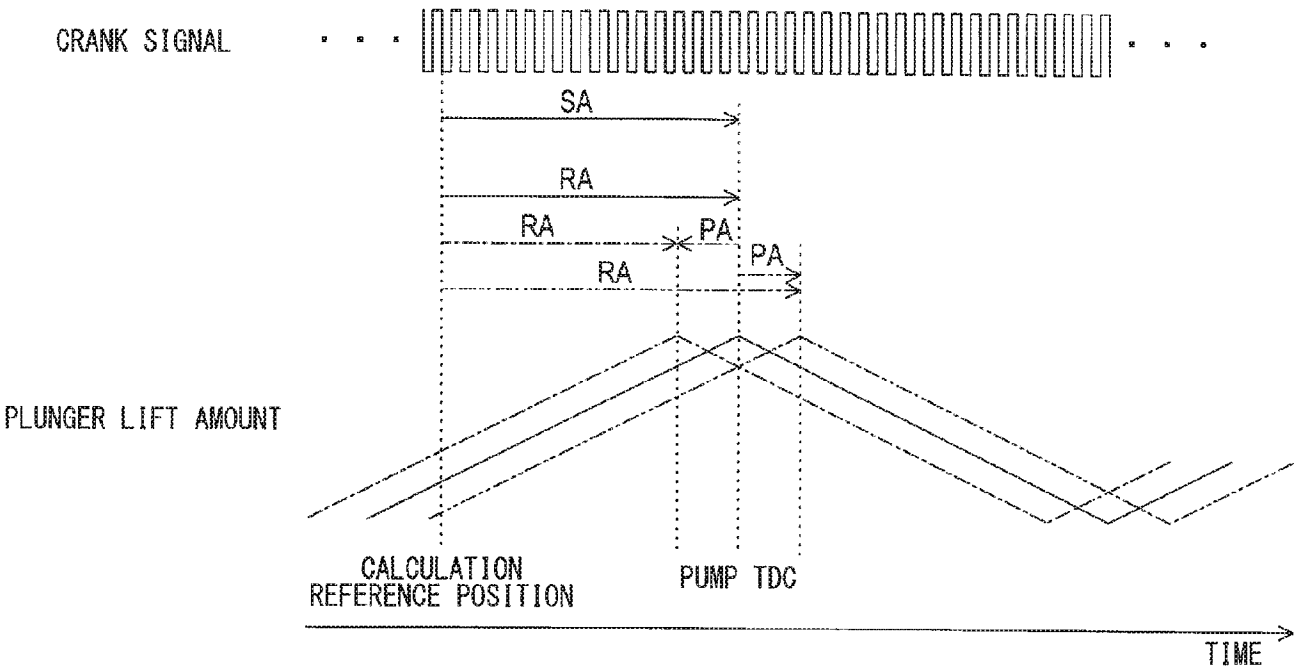
FIG. 9 is an explanatory view showing a relationship between a calculation reference position and a pump TDC timing.
Figure 10:
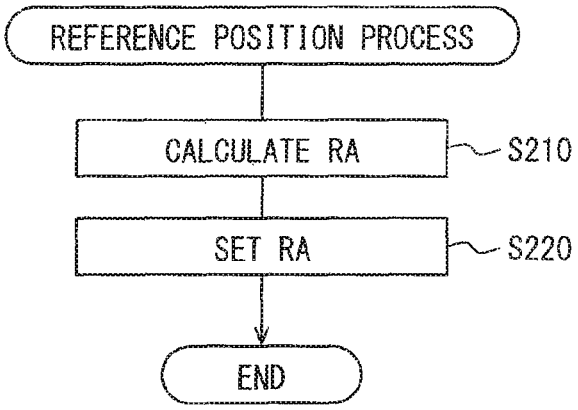
FIG. 10 is a flowchart showing a reference position process.

As shown in FIG. 9, the microprocessor 51 performs the reference position process of FIG. 10 when the engine position is in a calculation reference position, in advance of the pump TDC timing. For example, if the cam 24 is formed such that the plunger 22 reaches top dead center for every 120° of rotation by the camshaft 23, the calculation reference position is set to engine positions at intervals of 240° CA (crank angle). Further, in FIG. 9, "crank signal" refers to the output signal of the crank angle sensor 44.

When performing the reference position process of FIG. 10, first at S210, the microprocessor 51 calculates a relative crank angle RA. The relative crank angle RA is, as shown in FIG. 9, a crank angle until the subsequent pump TDC timing.

First, it is assumed that the engine includes a variable valve timing mechanism which changes a relative angle of the camshaft 23 with respect to the crankshaft of the engine. Further, during a standard state in which the variable valve timing mechanism sets the relative angle to 0, a standard relative crank angle SA is defined as the crank angle from the calculation reference position until the next engine position where the plunger 22 is at top dead center.

In this case, at S210, the microprocessor 51 may calculate the relative crank angle RA as the standard relative crank angle SA increased or decreased by a controlled relative angle PA, as shown in FIG. 9. The controlled relative angle PA is defined as the relative angle currently adjusted by the variable valve timing mechanism.

In FIG. 9, the solid line shows when the controlled relative angle PA is 0. In this case, the relative crank angle RA is calculated to be equal to the standard relative crank angle SA. Further, in FIG. 9, the one-dot-one-dash shows when the rotation of the camshaft 23 is advanced with respect to the crankshaft. In this case, the relative crank angle RA is calculated by subtracting the controlled relative angle PA from the standard relative crank angle SA. Further, in FIG. 9, the two-dot-one-dash shows when the rotation of the camshaft 23 is retarded with respect to the crankshaft. In this case, the relative crank angle RA is calculated by adding the controlled relative angle PA to the standard relative crank angle SA.

Conversely, if the engine does not include a variable valve timing mechanism, the relative crank angle RA does not change. Accordingly, at S210, the microprocessor 51 may treat the relative crank angle RA as being equal to the standard relative crank angle SA.

Next, at S220, the microprocessor 51 sets the relative crank angle RA calculated at S210 as an event generation counter. Then, execution of the reference position process ends.

The event generation counter is for causing an event—for example, an interrupt request—to be generated each time the engine position detected by the microprocessor 51 advances by the crank angle set to this counter. Then, when an interrupt request is generated, the microprocessor 51 performs the energize timing setting process of FIG. 11. In effect, the microprocessor 51 executes the energize timing setting process of FIG. 11 at each pump TDC timing.

As an alternative, at S220, the relative crank angle RA calculated at S210 may be converted into time based on the engine speed, and this converted time may be set to an internal timer. Then, when this time elapses, an interrupt request is generated and the process of FIG. 11 is performed.

Figure 11:
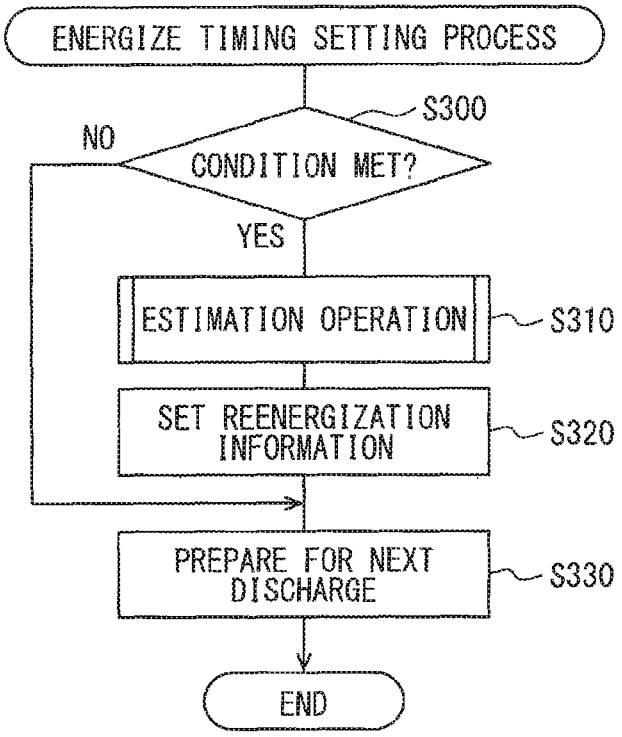
FIG. 11 is a flowchart showing an energize timing setting process.

As shown in FIG. 11, when the energize timing setting process begins, at S300, the microprocessor 51 determines whether the aforementioned noise reduction implementation condition is met. Then, if it is determined that the noise reduction implementation condition is met, the process continues to S310. At S310, the microprocessor 51 calculates the valve opening time delay Td by performing the previously described estimation operation process of FIG. 6. The process then continues to S320.

The microprocessor 51 includes a reenergization information storage unit. At S320, the microprocessor 51 sets the valve opening time delay Td calculated at S310 to the reenergization information storage unit. Here, the valve opening time delay Td represents a timing for beginning the noise reduction reenergization. The reenergization information storage unit may be, for example, a register located in a predetermined memory location of the RAM 54.

Figure 12:
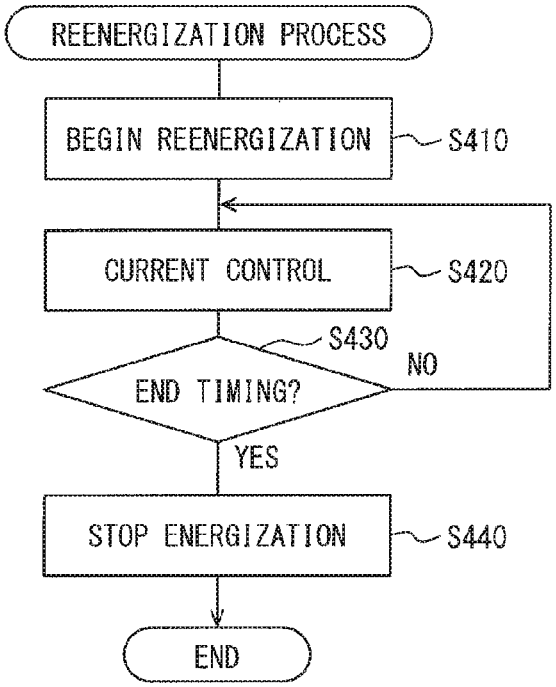
FIG. 12 is a flowchart showing a reenergization process.

Then, when the valve opening time delay Td set in the reenergization information storage unit at S320 elapses, the microprocessor 51 performs a reenergization process of FIG. 12 to implement the noise reduction reenergization. The reenergization process of FIG. 12 will be described later.

After performing the above processing of S320, or if it is determined that the noise reduction implementation condition is not met at S300, the microprocessor 51 proceeds to S330. Then, at S330, the microprocessor 51 performs a setup process for implementing the subsequent discharge energization.

Specifically, the microprocessor 51 includes a first storage unit and a second storage unit. The first storage unit has set therein discharge starting information representing a timing for starting the discharge energization. The second storage unit has set therein discharge ending information representing a timing for ending the discharge energization. Each of the first and second storage units may be, for example, a register located in a predetermined memory location of the RAM 54.

At S330, the microprocessor 51 calculates a start timing and an end timing for the subsequent discharge energization based on a target pipe pressure. The calculated start timing and end timing are during the subsequent plunger rise period. Further, the microprocessor 51 sets the discharge starting information representing the calculated start timing in the first storage unit, and sets the discharge ending information representing the calculated end timing in the second storage unit. The discharge starting information set in the first storage unit may be, for example, an engine position corresponding to the start timing of the discharge energization, a crank angle until this start timing, or a time until this start timing. The same applies to the discharge ending information set in the second storage unit.

After S330, the microprocessor 51 terminates the energize timing setting process.

Figure 13:
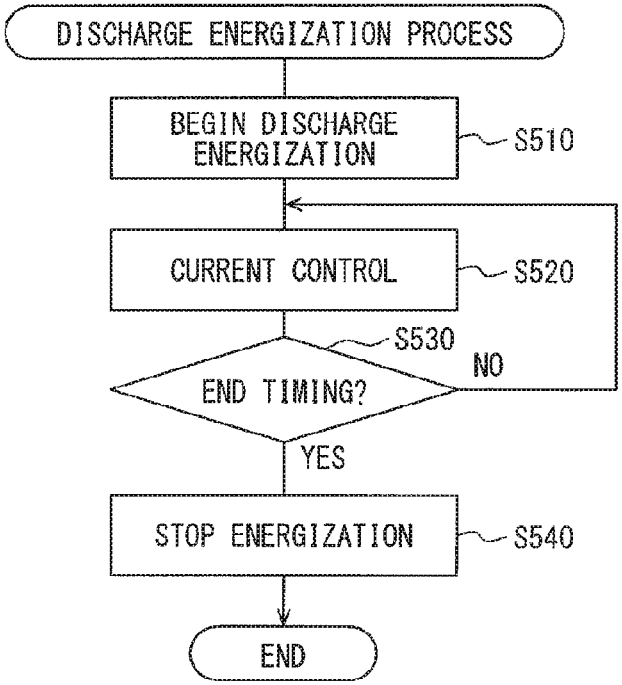
FIG. 13 is a flowchart showing a discharge energization process.

Further, upon reaching the timing indicated by the discharge starting information set in the first storage unit, the microprocessor 51 carries out a discharge energization by performing a discharge energization process of FIG. 13. The discharge energization process of FIG. 13 will be explained later.

(Reenergization Process)

In the microprocessor 51, when the valve opening time delay Td set in the reenergization information storage unit at S320 of FIG. 11 elapses, an event indicating this, such as an interrupt request, is generated. When that interrupt request is generated, the microprocessor 51 performs the reenergization process of FIG. 12.

As shown in FIG. 12, when the reenergization process begins, first at S410, the microprocessor 51 begins energizing the solenoid 35 (in other words, begins the noise reduction reenergization).

Then, at S420, the microprocessor 51 performs a current control for setting the solenoid drive current to the previously described current I3.

Next, at S430, the microprocessor 51 determines whether the end timing of the noise reduction energization has been reached. Specifically, the microprocessor 51 determines whether the aforementioned predetermined period of time has elapsed since beginning the energization at S410. This predetermined period of time is equal to the duration of the noise reduction reenergization.

If the microprocessor 51 determines at S430 that the end timing of the noise reduction reenergization has not been reached, the microprocessor 51 returns to S420 and continues to apply the noise reduction reenergization.

After that, when the microprocessor 51 determines at S430 that the end timing of the noise reduction energization has been reached, the process continues to S440. At S440, the microprocessor 51 stops the energization of the solenoid 35, and then terminates this reenergization process.

(Discharge Energization Process)

Further, in the microprocessor 51, upon reaching the timing indicated by the discharge starting information set in the first storage unit at S330 of FIG. 11, an event indicating this, such as an interrupt request, is generated. When that interrupt request is generated, the microprocessor 51 performs the discharge energization process of FIG. 13.

As shown in FIG. 13, when the discharge energization process begins, first at S510, the microprocessor 51 begins energizing the solenoid 35 (i.e., begins applying the discharge energization). Then, at S520, the microprocessor 51 performs a current control for controlling the solenoid drive current.

Further, if the microprocessor 51 had determined that the noise reduction implementation condition is met at S300 of FIG. 11, then during the current control of S520, the previously mentioned gradual current increase process is performed, to gradually increase the solenoid drive current until reaching the target maximum current value I1. After that, the microprocessor 51 maintains the solenoid drive current at the previously mentioned retention current I2. Further, if the microprocessor 51 had determined that the noise reduction implementation condition is not met at S300 of FIG. 11, the microprocessor 51 controls the solenoid drive current to quickly increase until reaching the target maximum current I1. After that, the microprocessor 51 maintains the solenoid drive current at the previously mentioned retention current I2.

Next, at S530, the microprocessor 51 determines whether the end timing of the discharge energization has been reached. The end timing of the discharge energization is a point in time prior to the pump TDC timing. Specifically, the microprocessor 51 determines whether the timing represented by the discharge ending information set in the second storage unit at S330 of FIG. 11 has been reached.

If the microprocessor 51 determines at S530 that the end timing of the discharge energization has not been reached, the microprocessor 51 returns to S520 and continues to apply the discharge energization.

After that, when the microprocessor 51 determines at S530 that the end timing of the discharge energization has been reached, the process continues to S540. At S540, the microprocessor 51 stops the energization of the solenoid 35, and then terminates this discharge energization process.

(Effects)

The microprocessor 51 of the ECU 41 estimates the valve opening time delay Td based on the pipe pressure. Then, the microprocessor 51 begins reenergization the solenoid 35 to reduce noise when this estimated valve opening time delay Td elapses from the pump TDC timing. Accordingly, the timing for starting the reenergization of the solenoid 35 may be matched with, or set close to, the actual valve opening timing of the regulator valve 28. For this reason, it is possible to avoid starting the reenergization too late, which may reduce the noise reduction effect of the reenergization process. Further, it is possible to avoid starting the reenergization too early, which may consume excess power. Accordingly, it is possible to both reduce noises generated in the high pressure pump 16, and at the same time avoid consuming excess energy during the noise reduction process.

Further, the microprocessor 51 terminates the discharge energization prior to the pump TDC timing. As a result, the regulator valve 28 is closed due to the pump chamber pressure for at least a period of time between the termination of the discharge energization and the pump TDC timing. For this reason, power consumption may be further reduced.

After the discharge energization ends, the microprocessor 51 detects the pipe pressure at the pump TDC timing, and then calculates the valve opening time delay Td using the detected pipe pressure. Accordingly, the valve opening time delay Td may be calculated based on pipe pressures corresponding to the same plunger lift amount each time. Specifically, the valve opening time delay Td may be calculated based on the pipe pressure corresponding to the peak value of the pump pressure chamber due to the rise of the plunger 22. As such, the valve opening time delay Td may be calculated each time with high accuracy. In other words, the estimation accuracy of the valve opening timing of the regulator valve 28 may be improved.

Further, the microprocessor 51 calculates the pump chamber pressure to be a greater value as the detected pipe pressure is greater. In turn, the microprocessor 51 calculates the valve opening time delay Td to be a greater value as the calculated pump chamber pressure is greater. Accordingly, the valve opening time delay Td may be accurately calculated.

Further, according to the present embodiment, the spring 31 corresponds to a first spring, the spring 34 corresponds to a second spring, the delivery pipe 18 corresponds to a fuel storage unit, and the ECU 41 corresponds to a high pressure pump controller. Further, the microprocessor 51 functions as each of a discharge energizer, an estimator, and a reenergizer. Further, among the various processes performed by the microprocessor 51, S510, S520, S530, and S540 of FIG. 13 correspond to the processing performed by the discharge energizer. Further, S110, S120, S130, S140, and S150 of FIG. 6 correspond to the processing performed by the estimator. Further, S410, S420, S430, and S440 of FIG. 12 correspond to the processing performed by the reenergizer.

First Modified Example

Figure 14:
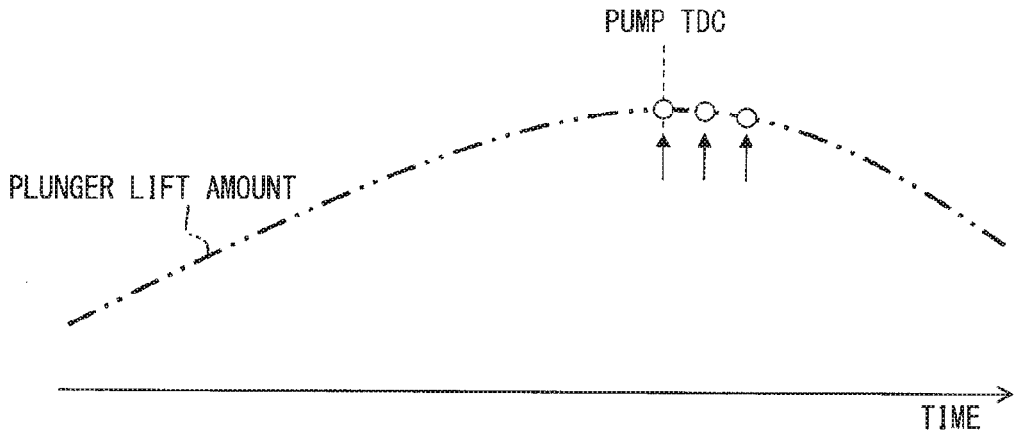
FIG. 14 is an explanatory view of a modified embodiment.

In S110 of the estimation operation process of FIG. 6, the microprocessor 51 may perform a plurality of consecutive A/D conversions on the output signal of the pressure sensor 40, as shown by the upward arrows in FIG. 14. In other words, the pipe pressure may be detected multiple times consecutively.

In this configuration, the pump chamber pressure may be, for example, calculated as an average of the multiple detected values of the pipe pressure, or multiple pump chamber pressures may be calculated from each of those detection values and then averaged. As a result, the effect of noise included in the signal of the pressure sensor 40 and the effect of variations in the fuel pressure may be removed. Accordingly, the estimation accuracy of the valve opening time delay Td, or in other words the estimation accuracy of the valve opening timing of the regulator valve 28, may be improved.

As another example, changes in the pipe pressure or the pump chamber pressure may be estimated based on the plurality of detection values of the pipe pressure or the plurality of calculated pump chamber pressures from each detection value. Then, by taking into consideration the estimated pressure change, the estimation accuracy of the valve opening time delay Td may be increased.

Second Modified Example

The microprocessor 51 may perform the estimation operation process of FIG. 6, or at least S110 of the estimation operation process (i.e., the detection f the pump chamber pressure) during the period of time between the discharge energization ending and the pump TDC timing. In this configuration as well, an accuracy valve opening time delay Td may be calculated based on a pipe pressure close to the pump TDC timing.

Third Modified Example

The regulator valve spring force, the movable portion spring force, and the low pressure fuel pressure used in calculating the valve opening time delay Td during the estimation operation process of FIG. 6 may be treated as constants. Accordingly, the microprocessor 51 may disregard one or all of these variables when calculating the valve opening time delay Td.

For example, during the estimation operation process of FIG. 6, the microprocessor 51 may be configured to calculate the valve opening time delay Td using only the pump chamber pressure calculated as S130. In this case, instead of the valve opening time delay calculation table of FIG. 8, the ROM 53 may store a table representing a relationship between the pump chamber pressure at the pump TDC timing and the valve opening time delay Td. Such a table would be set such that as the pump chamber pressure calculated at S130 increases, a larger valve opening time delay Td would be calculated. Then, the microprocessor 51 may use this table to calculate the valve opening time delay Td corresponding to the pump chamber pressure calculated at S130.

Further, as previously mentioned, the pump chamber pressure is correlated to the pipe pressure at the pump TDC timing. For this reason, during the estimation operation process of FIG. 6, the microprocessor 51 may skip calculating the pump chamber pressure, and simply calculate the valve opening time delay Td based on the pipe pressure calculated at S120 (i.e., the detection value of the pipe pressure). In this case, for example, instead of the valve opening time delay calculation table of FIG. 8, the ROM 53 may store a table representing a relationship between the pipe pressure at the pump TDC timing and the valve opening time delay Td. Such a table would be set such that as the pipe pressure calculated at S120 increases, a larger valve opening time delay Td would be calculated. Then, the microprocessor 51 may use this table to calculate the valve opening time delay Td corresponding to the pipe pressure calculated at S120. In other words, the valve opening timing of the regulator valve 28 may be estimated using at least the pipe pressure.

Fourth Modified Example

During S320 of FIG. 11, the microprocessor 51 may convert the valve opening time delay Td calculated at S310 into a crank angle based on the engine rotation speed. Then, the microprocessor 51 may set that converted crank angle as start timing information for the noise reduction reenergization in the reenergization information storage unit. In this case, when the engine position detected by the microprocessor 51 advances by the crank angle set in the reenergization information storage unit, the microprocessor 51 performs the reenergization process of FIG. 12.

In addition, each of the first to fourth modified embodiments may be combined as appropriate.

Other Embodiments

The present disclosure is explained with reference to the above embodiments, but is not intended to be limited to the above embodiments. A variety of modifications are contemplated.

For example, the function of a particular element in the above embodiments may be divided into a plurality of elements, or the functions of a plurality of elements may be combined into a single element. Further, a portion of the configuration of the above embodiments may be omitted. Further, in addition to the high pressure pump controller, the present disclosure may be embodied by a system having elements corresponding to this high pressure pump controller, a program that when executed by a computer acts as this high pressure pump controller, a non-transitory computer readable storage media such as a semiconductor memory storing such a program, or a method of controlling a high pressure pump.

The invention claimed is:

1. A high pressure pump controller for controlling a high pressure pump, comprising:

a discharge energizer;

an estimator; and a reenergizer, wherein the high pressure pump includes a pump chamber having an inlet and an outlet for fuel, a plunger that reciprocates within the pump chamber, a regulator valve that opens and closes a fuel passage connected to the inlet, a first spring that biases the regulator valve in a closing direction along a movement direction of the regulator valve, the regulator valve configured to close the fuel passage in the closing direction, and an electromagnetic actuator that causes the regulator valve to move to open and close, the electromagnetic actuator includes a movable portion biased by a second spring in an opening actuation direction to push the regulator valve in an opening direction, the opening direction being opposite to the closing direction, and a solenoid that, when energized, attracts the movable portion in a direction opposite to the opening actuation direction, the outlet is connected to a fuel storage unit which stores fuel to be supplied to an injector, a plunger rise period is defined as when the plunger is rising from bottom dead center to top dead center, and during the plunger rise period, the solenoid is energized to close the regulator valve such that fuel in the pump chamber is discharged from the outlet into the fuel storage unit, and during the plunger rise period, once the regulator valve is closed, even if the solenoid is deenergized, the regulator valve is maintained in a closed state by a fuel pressure of the pump chamber, the discharge energizer is configured to, during the plunger rise period, energize the solenoid to close the regulator valve and to discharge the fuel from the outlet, the discharge energizer is configure to, prior to the plunger reaching top dead center, deenergize the solenoid, the estimator is configured to estimate a valve opening timing based on a fuel pressure of the fuel storage unit, the valve opening timing being when the regulator valve begins to open the fuel passage as a result of the discharge energizer deenergizing the solenoid, and the reenergizer is configured to, upon reaching the valve opening timing estimated by the estimator, reenergize the solenoid to reduce a movement speed of the movable portion in the opening actuation direction.

2. The high pressure pump controller of claim 1, wherein the estimator is configured to, after the discharge energizer deenergizes the solenoid, detect the fuel pressure of the fuel storage unit and estimate the valve opening timing based on the detected fuel pressure.

3. The high pressure pump controller of claim 2, wherein the estimator is configured to detect the fuel pressure upon the plunger reaching top dead center.

4. The high pressure pump controller of claim 2, wherein the estimator is configured to detect the fuel pressure multiple times upon the plunger reaching top dead center, and estimate the valve opening timing based on the multiple detected values.

5. The high pressure pump controller of claim 2, wherein the estimator is configured to, as the detected fuel pressure increases, calculate the valve opening timing such that a greater period of time exists between the plunger reaching top dead center and the valve opening timing.

6. The high pressure pump controller of claim 1, wherein the reenergizer is configured to reenergize the solenoid contemporaneous with the valve opening timing estimated by the estimator.

* * * * *